United States Patent [19]

Hendricks

[11] 4,209,116

[45] Jun. 24, 1980

[54] MISCELLANEOUS ITEMS CARRIER

[76] Inventor: Charles D. Hendricks, 803 Indiana Ave., LaPorte, Ind. 46350

[21] Appl. No.: 954,839

[22] Filed: Oct. 26, 1978

[51] Int. Cl.[2] ..... B65D 75/00

[52] U.S. Cl. ..... 224/49; 224/45 R; 150/12; 220/94 A

[58] Field of Search ..... 224/45 R, 45 D, 45 E, 224/45 H, 45 L, 45 P, 49; 220/94 R, DIG. 13, DIG. 12, DIG. 25, 94 A; 229/54 R, 55, 58; 150/1, 1.5, 12, 2, 48; 190/57

[56] References Cited

U.S. PATENT DOCUMENTS

| | | | |
|---|---|---|---|
| Re. 28,278 | 1/1974 | Borse | 220/94 A X |
| 1,727,578 | 9/1929 | Wengard | 224/45 P UX |
| 2,617,569 | 11/1952 | Sommer | 150/12 UX |
| 3,316,951 | 5/1967 | Jacobson | 150/1.5 R UX |
| 3,402,749 | 9/1968 | Kinzler | 150/12 X |
| 3,421,302 | 1/1969 | Dahl | 150/2 X |

FOREIGN PATENT DOCUMENTS

| | | | |
|---|---|---|---|
| 2004539 | 8/1971 | Fed. Rep. of Germany | 150/12 |
| 2215675 | 10/1973 | Fed. Rep. of Germany | 150/12 |

*Primary Examiner*—Robert J. Spar

*Assistant Examiner*—Jerold M. Forsberg

*Attorney, Agent, or Firm*—Clarence A. O'Brien; Harvey B. Jacobson

[57] ABSTRACT

A flexible panel member is provided including upright horizontally spaced apart and elongated sides interconnected along their lower marginal edge portions by a bottom extending between and anchored relative to the side lower marginal edge portions. An upstanding end wall extends and is secured between at least the lower portions of the sides at one pair of corresponding ends thereof and the upper marginal edge portions of the sides include stiffening members extending therealong from at least areas thereof spaced centrally intermediate the opposite ends of the sides toward the aforementioned first pair of ends thereof. The second pair of corresponding ends of the sides are at least substantially free of connections extending therebetween above the bottom and the portions of the stiffening members supported from the longitudinal central areas of the upper marginal edges of the sides include structure defining elongated horizontal hand grips extending longitudinally of the sides. The bottom is downwardly inclined toward the first pair of corresponding ends of the sides when the hand grips are horizontally disposed.

11 Claims, 5 Drawing Figures

MISCELLANEOUS ITEMS CARRIER

BACKGROUND OF THE INVENTION

Various forms of foldable carriers for different items have been heretofore provided. Many of such carriers define upwardly opening troughs closed at one end and in which various items may be supported. However, these previously known forms of carriers are not specifically designed to provide bottom walls thereof inclined downwardly toward the closed ends of the troughs and, as a result, items placed within the troughs have a tendency to slip out of the open ends thereof, the troughs each being usually provided with one open end whereby items longer than the troughs may be supported therein.

Examples of carriers of the above-mentioned type and other carriers including some of the general structural and operational features of the instant invention are disclosed in U.S. Pat. Nos. 1,120,924, 1,462,897, 1,766,258, 3,128,022 and 3,779,156.

However, for the above stated reasons, the above described forms of carriers are not as desirable as a carrier specifically designed to provide a bottom wall therefor inclined downwardly toward the closed end of the elongated trough-shaped carrier.

BRIEF DESCRIPTION OF THE INVENTION

The carrier of the instant invention is constructed of flexible materials and includes a pair of elongated opposite sides between which an elongated bottom extends. The upper marginal edge portions of the sides include stiffening structures extending longitudinally therealong and also defining hand grip portions spaced longitudinally thereof which may be alternately grasped to support the carrier. Further, one end of the carrier is provided with an end wall and is therefore closed and the bottom of the carrier is downwardly inclined toward the closed end thereof when the hand grips are horizontally disposed, the hand grips being horizontally disposed when the carrier is being carried from one location to the other with articles supported therein.

In addition, the carrier has the upper marginal edges of the sides thereof interconnected only at the closed end of the carrier whereby the stiffened upper edges of the side walls may be opened by swinging the ends thereof remote from the closed end of the carrier apart.

The main object of this invention is to provide an items carrier which may be utilized to carry miscellaneous items from one location to another.

Another object of this invention is to provide a miscellaneous items carrier constructed in a manner whereby variously shaped items including items longer than the carrier may be carried therein.

Still another object of this invention is to provide a trough-shaped carrier closed at one end and constructed in a manner whereby when the handle portions of the carrier are utilized to support the carrier and the load contained therein, the bottom wall of the carrier will automatically be downwardly inclined toward the closed end thereof.

A final object of this invention to be specifically enumerated herein is to provide an items carrier in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
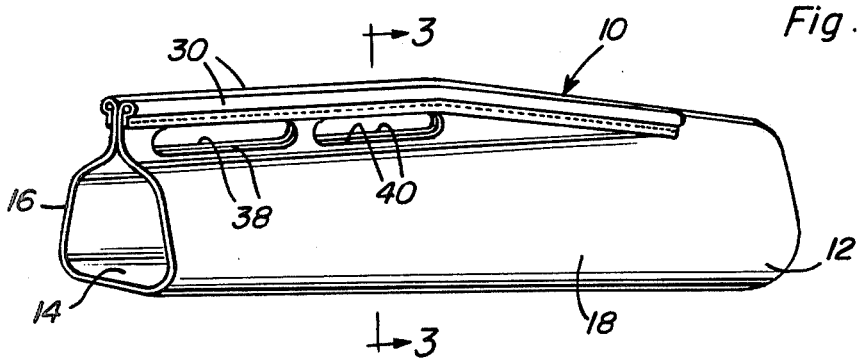
FIG. 1 is a perspective view of the items carrier with the latter in a closed condition.
Figure 2:
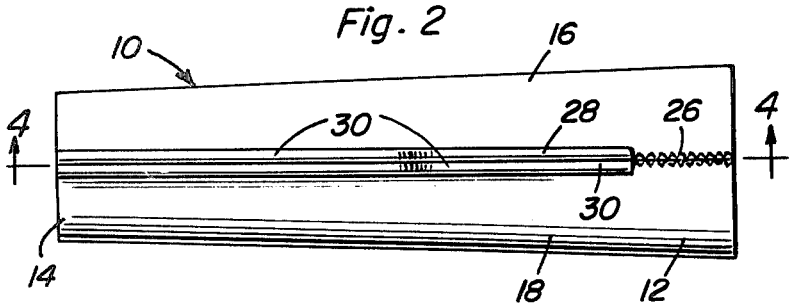
FIG. 2 is a top plan view of the assemblage illustrated in FIG. 1.
Figure 3:
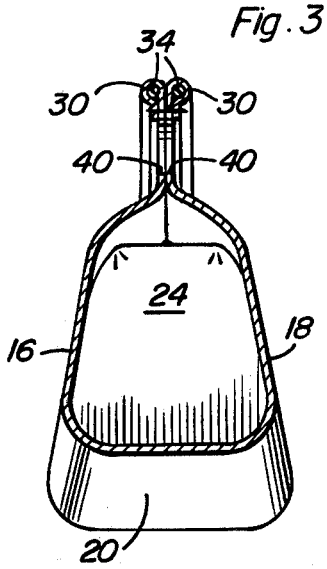
FIG. 3 is an enlarged transverse vertical sectional view taken substantially upon a plane indicated by the section line 3—3 of FIG. 1.

Referring now more specifically to the drawings, the numeral 10 generally designates the carrier of the instant invention. The carrier 10 defines an elongated trough-like structure including first and second closed and open ends 12 and 14. The carrier 10 is constructed of flexible panel material and preferably of a heavy fabric material. The carrier 10 includes horizontally elongated upstanding sides 16 and 18 extending longitudinally of the carrier and interconnected by means of an integral bottom 20 extending between the lower marginal edges of the sides 16 and 18. In addition, the end of the bottom 20 adjacent the end 12 of the carrier 10 curves upwardly as at 22 and forms an upstanding end wall 24 extending and secured between the corresponding ends of the sides 16 and 18.

The upper marginal edges of the sides 16 and 18 adjacent the closed end of the carrier 10 are secured together as at 26 and the remaining upper marginal edges of the sides 16 and 18 include longitudinally extending hems 28 and 30 in which rod-like stiffening members 32 are secured. The rod-like stiffening members 32 include corresponding horizontal end portions 34 and downwardly inclined end portions 36 which extend toward the closed end of the carrier 10.

The sides 16 and 18 each have longitudinally spaced openings 38 and 40 formed therethrough and the sides 16 and 18 may be suitably reinforced in areas extending about the openings 38 and 40. The pairs of openings 38 and 40, in conjunction with the rod stiffened hems 28 and 30, define longitudinally spaced horizontal hand grips for the carrier 10 whereby the fingers of the user's hand may be inserted through one pair of corresponding openings 38 or 40 for the purpose of supporting the carrier 10. The specific pair of openings 38 or 40 chosen to be used as hand grips is determined by the loading of the carrier 10. A greater portion of the weight of the load of the carrier 10 being disposed in the closed end thereof requires that the openings 40 be used to form the hand grips. However, if a considerable number of items longer than the carrier 10 are supported therein and the open end of the carrier 10 is therefore more heavily loaded, the openings 38 may be utilized to define the hand grip openings.

The sides 16, 18, the bottom 20 and the end wall 24 may be formed of a single piece of heavy fabric material such as canvas. Of course, the rod-like stiffening members 32 may comprise rod members of any suitable material, such as plastic, aluminum, or steel.

Figure 5:
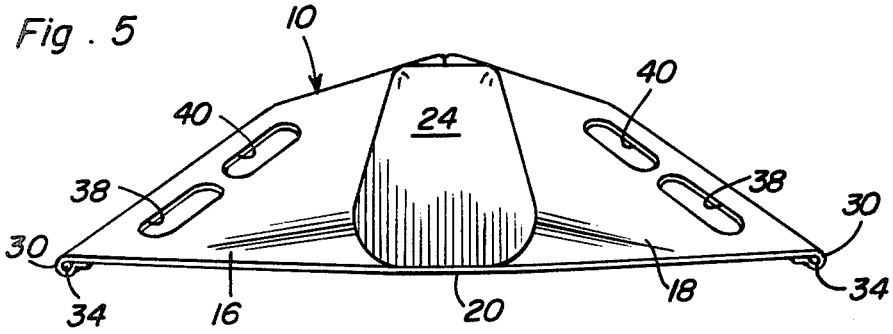
FIG. 5 is an end elevational view of the carrier as seen from the open end thereof and with the end portions of the side walls thereof adjacent the open end of the carrier in relatively divergent open conditions.

With attention now invited more specifically to FIG. 5 of the drawings, it may be seen that the ends of the stiffening members 32 remote from the closed end of the carrier 10 may be arranged in relatively divergent relation with the corresponding ends of the hems 28 and 30 disposed in substantially the same horizontal plane as the bottom 20 and, therefore, positionable for support for the same horizontal surface upon which the bottom 20 rests. In this manner, the carrier 10 is opened wide and access may be readily had to various articles therein, or numerous articles may be received within the carrier 10. Then, when it is desired to suspend the carrier 10 from the user's hand in order to carry the carrier 10 and the articles disposed therein, the ends of the stiffened upper marginal edges of the side walls 16 and 18 remote from the end walls may be swung upwardly and together in order that the carrier 10 may assume the closed position illustrated in FIG. 1. Thereafter, according to the longitudinal center of gravity of the load within the carrier 10, either the openings 38 or the openings 40 may be utilized to define the finger receiving hand grips for suspending the carrier 10 from the user's hand, the openings 40 being generally centered over the longitudinal center of the interior of the carrier 10 for general centering over an elongated load supported within the carrier 10.

Figure 4:
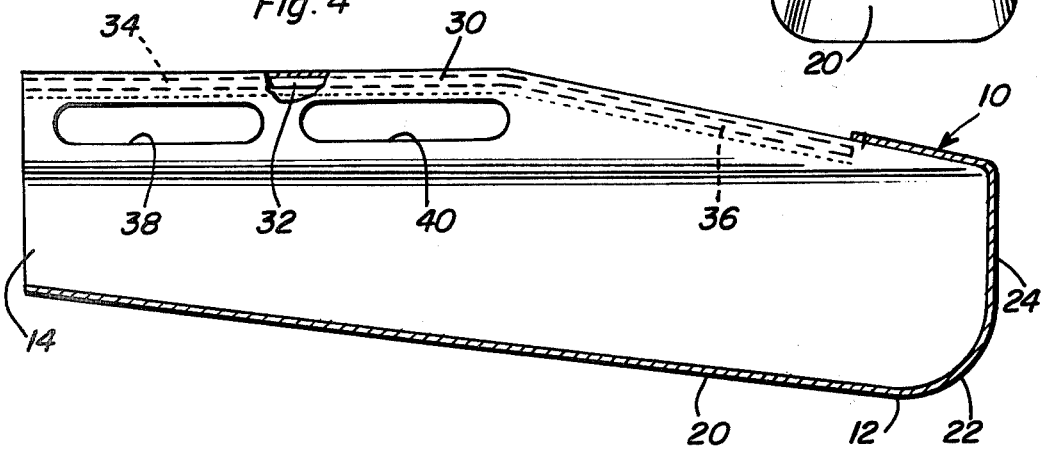
FIG. 4 is an enlarged longitudinal vertical sectional view taken substantially upon a plane indicated by the section line 4—4 of FIG. 2.

With attention now invited more specifically to FIG. 4 of the drawings, it will be seen that when the stiffened upper marginal edge portions of the sides 16 and 18 defining the hand grips are horizontally disposed, the bottom 20 is inclined downwardly toward the closed end of the carrier 10. Thus, when a plurality of miscellaneous articles are supported within the carrier 10 and the hand grip portions being utilized to support the carrier 10 are horizontally disposed, there will be no tendency for the articles disposed within the carrier 10 to fall from the open end thereof. Rather, if there is any tendency for the articles within the carrier 10 to shift longitudinally thereof, they will shift, by gravity, toward the closed end of the carrier.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An elongated carrier for miscellaneous items, said carrier comprising a flexible panel member including upright horizontal spaced apart and horizontally elongated sides interconnected along their lower marginal edge portions by a bottom extending between and anchored relative to said side lower marginal edge portions, an upstanding end wall integral with said bottom wall extending and secured between at least the lower portions of said sides at one end of said carrier, major length portions of the upper marginal edge portions of said sides including stiffening members supported thereby and extending therealong from longitudinal central portions thereof spaced centrally intermediate the opposite end of said carrier toward said end wall, the end of said carrier opposite said end wall being fully open and free of connecting structure extending and connected therebetween and said major length portions being free of connecting structure extending and connected therebetween, whereby when said carrier is placed on a horizontal surface said upper marginal portions adjacent said open end of said carrier may be swung outwardly and downwardly, and when said carrier is to be picked up said central portions may be gripped and swung upwardly and inwardly toward side-by-side positions, the portions of said stiffening members supported by said central portions including means defining elongated horizontal hand grips extending longitudinally of said carrier which register with each other when said central portions are disposed in side-by-side relation, said bottom being slightly downwardly inclined toward said one end of said carrier when said hand grips are horizontally disposed, said central portions being generally centered over the longitudinal center of the interior of said carrier for general centering over an elongated load supported within said carrier, whereby the downward incline of said bottom wall toward said one end insures that equipment disposed within said carrier wall not fall from the open end thereof.

2. The combination of claim 1 wherein said upstanding end wall comprises a full end wall extending between the corresponding end edges of said sides.

3. The combination of claim 2 wherein the upper marginal edges of said sides adjacent said end wall are secured together.

4. The combination of claim 1 wherein said stiffening members extend substantially the full length of said upper marginal edge portions of said sides from the ends of said sides remote from said end wall to positions closely adjacent said end wall.

5. The combination of claim 4 wherein the end portions of said stiffening members adjacent said end wall are slightly downwardly inclined.

6. The combination of claim 5 wherein said upstanding end wall comprises a full end wall extending between the corresponding end edges of said sides.

7. The combination of claim 6 wherein the upper marginal edges of said sides adjacent said end wall are secured together.

8. The combination of claim 1 wherein said panel member comprises a single one-piece panel member.

9. The combination of claim 8 wherein the upper marginal edges of said sides include hems, said stiffening members including elongated stiffening members secured in said hems.

10. The combination of claim 9 wherein said stiffening members extend substantially the full length of said upper marginal edge portions of said sides from the ends of said sides remote from said end wall to positions closely adjacent said end wall.

11. The combination of claim 10 wherein the end portions of said stiffening members adjacent said end wall are slightly downwardly inclined.

* * * * *